United States Patent [19]

Brock

[11] 4,340,199

[45] Jul. 20, 1982

[54] HANGING DEVICE OR CATCH

[76] Inventor: Rita Brock, 4815 Schloss-Holte, Stuckenbrock, Asterhweg 12, Fed. Rep. of Germany

[21] Appl. No.: 80,575

[22] Filed: Oct. 1, 1979

[30] Foreign Application Priority Data

May 8, 1979 [DE] Fed. Rep. of Germany ... 7913186[U]

[51] Int. Cl.[3] ..... A47G 1/16

[52] U.S. Cl. ..... 248/544; 248/221.3; 248/490

[58] Field of Search ..... 248/221.3, 221.4, 223.4, 248/297.3, 297.5, 477, 478, 488, 489, 490, 496, 544

[56] References Cited

U.S. PATENT DOCUMENTS

| | | | |
|---|---|---|---|
| 2,262,287 | 11/1941 | Johnson | 248/496 |
| 2,696,962 | 12/1954 | Goss | 248/477 |
| 3,349,443 | 10/1967 | Sury | 248/490 X |
| 3,388,884 | 6/1968 | Eggler et al. | 248/221.3 |
| 3,495,896 | 2/1970 | Barcus et al. | 248/477 X |
| 3,692,266 | 9/1972 | Jacobs | 248/544 X |
| 4,077,597 | 3/1978 | Greig | 248/477 |
| 4,217,710 | 8/1980 | Becker | 248/490 X |

FOREIGN PATENT DOCUMENTS

| | | | |
|---|---|---|---|
| 7707911 | 7/1977 | Fed. Rep. of Germany | 248/221.4 |

*Primary Examiner*—William H. Schultz

*Attorney, Agent, or Firm*—David L. Garrison; Ford E. Smith

[57] ABSTRACT

An improved hanger having two pieces engageable and slidable with respect to each other. Curved guide grooves in one piece are engaged by projecting portions of leaf springs on the other piece. The curved guide groove corresponds to an arc of a circle. Each guide groove has one or more detents intermediate the ends of the groove.

8 Claims, 11 Drawing Figures

HANGING DEVICE OR CATCH

BACKGROUND OF THE INVENTION

The invention relates to a hanging device or catch consisting of at least two parts which slide one on the other and are made of spring-elastic plastic.

Such hanging devices are used, for example, for mirrors and unframed pictures covered with a sheet of glass. Catches can be used on doors in cabinets or the like, and also on boxes which are provided with hinged lids.

THE INVENTION

The object of the invention is to improve such hangers and catches so as to expand their usefulness and make their operation more secure.

This object is achieved by a hanger or catch consisting of at least two parts guided for displacement one on the other and made of spring-elastic plastic, having a first part which consists of at least one leaf spring provided at its free end with a projection for engagement in a guiding groove disposed on the second part at an angle with respect to the leaf spring, the guiding groove being of curved configuration corresponding approximately to an arc of a circle. If two or more leaf springs are provided, a guiding groove is associated with each such leaf spring. It is desirable for the guiding grooves to be of a curved configuration and to form an arc of a circle. If two guiding grooves are provided opposite one another the apexes of the curves are the closest to one another.

In one advantageous embodiment, the guide grooves are provided with at least one detent for the projection on the leaf spring. If a plurality of detents is provided, at least one detent is disposed at the apex of the guiding groove and another detent is provided at a position approximately between the apex and the out-thrust end. In the case of a hanger, the second part consists of a planar portion in which the guiding grooves are disposed and which is provided with a hook which remains outside of the first part when the two parts are assembled. The length of the guiding groove from the apex to one of its ends, converted to the length of the displacement of the second part, corresponds at least to the width of the lip of the hooked portion thereof. In the planar portion of the second part there is provided an elongated aperture to provide access for a screwdriver to the throughbore provided in the first part for a fastening means. In this elongated aperture, at a point opposite the lip of the hook, there is advantageously disposed a resilient tongue projecting at an angle from the plane of the second part. According to an advantageous further development, this resilient tongue can be formed on a shank extending into the elongated aperture, this shank being also resilient.

One hanger or catch in accordance with the invention consists of only two pieces molded from plastic, which are simple to manufacture and after manufacture need only to be snapped together. The assembled hanger performs all functions for the hanging of mirrors and unframed pictures, both as a bottom support which substantially bears the weight and as a top support which substantially performs the retaining function. These functions are substantially improved by making the guiding groove of an arcuate configuration having two end positions and a central position at the apex of the arcuate guiding groove, which can be additionally defined by a detent; such a guiding groove serves to hold the upper, hook-shaped portion in the elevated position until the mirror or picture is inserted. This hook then needs only to be pushed downwardly in order to perform its retaining function. At the same time, the hanger is constructed such that the mirror or picture is urged against the outer lips of the hook portions of the second parts so as to assume a position at a sufficient distance from the wall and from the hangers. This is especially important in the case of mirrors so that when they are hung in a bathroom, for example, they will be sufficiently ventilated at the back when the atmosphere is damp.

BRIEF DESCRIPTION OF THE DRAWINGS

The invention will be further explained with the aid of embodiments in conjunction with the drawings, wherein.

DESCRIPTION OF THE PREFERRED EMBODIMENT

Figure 1C:
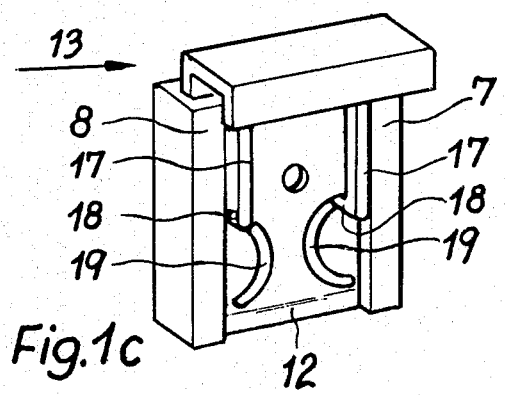
FIG. 1*c* shows the two parts of FIGS. 1*a* and 1*b* assembled.
Figure 2A:
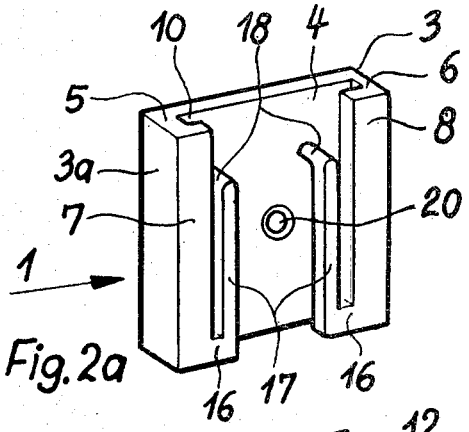
FIGS. 2*a* and 2*b* are perspective views of another embodiment of the hanger.
Figure 1B:
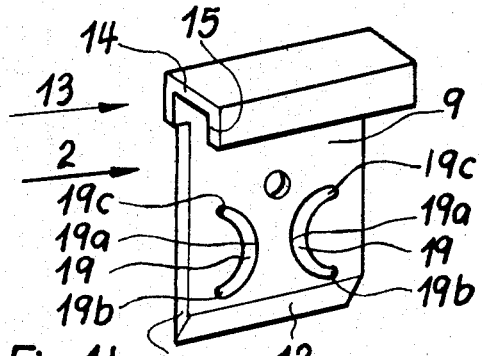
FIGS. 1*a* and 1*b* are perspective views of the two parts of a hanger in accordance with the invention.
Figure 1A:
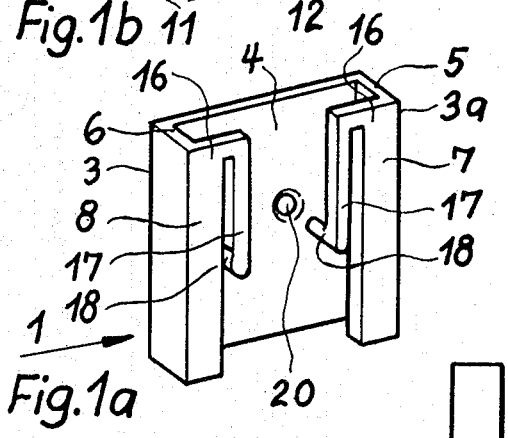

A hanger in accordance with FIGS. 1 to 6 consists of a first part 1 corresponding to FIGS. 1*a* or 2*a* and of a second part 2 corresponding to FIGS. 1*b* and 2*b*, or 4 to 6. The first part is essentially channel-shaped, consisting of a planar back portion 4 from whose lateral edges 3 and 3*a* the side portions 5 and 6 project at right angles and from the outer edges of the latter the lips 7 and 8 project inwardly, also at right angles.

These side portions 7 and 8 form a means for guiding part 2. Part 2 consists also of a planar back portion 9 of rectangular plan, whose thickness 11 corresponds approximately to the width of the slot 10 between the two inwardly directed lips 7 and 8 and the front surface of the back portion 4 of part 1. The width of the back portion 9 of part 2 corresponds approximately to the distance between the inside surface of portions 5 and 6 of part 1.

At the lower edge of part 2 in FIGS. 1*b* and 1*c*, there is a ramp 12, and a channel-shaped hook 13 is formed on the upper edge of part 2. This hook consists of a portion 14 projecting at a right angle from the planar back portion 9, and a lip portion 15 projecting downward from portion 14 at a right angle. This lip portion 15 is therefore disposed parallel to the planar back portion 9 of part 2. The distance between the inside surface of the planar back portion 9 and the inside surface of the lip portion 15 parallel therewith is great enough to provide space between them for a mirror or for a picture and its cover glass.

Each part 1 and 2 is made in one piece of plastic, specifically from a spring-elastic plastic such as polyamide or polycarbonate, for example. On part 1 there are formed at the free edges of portions 7 and 8, on a connecting portion 16, the leaf springs 17 disposed approximately parallel to the confronting edge surfaces of portions 7 and 8. These leaf springs 17 extend approximately over three quarters of the length of the lip portions 7 and 8 and thus also of the back portion 4.

On the free ends of the leaf springs 17 there are formed the projections 18 pointing towards the back 4, and they have a preferably round cross section, while the leaf springs themselves have preferably a rectangular cross sectional shape. The abovedescribed form of this part 1 is the same in all of the embodiments described herein. In accordance with the idea of the invention, the leaf springs 17 can also be made such that they are not parallel with the inner edges of portions 7 and 8 but are bent toward one another, so that projections 18 pointed at the back portion will be closely adjacent one another. This embodiment will depend upon the configuration of the guiding grooves 19, which will be discussed below.

In the embodiment represented in FIGS. 1*a* to 1*c*, arcuate grooves or slots 19 are formed in the planar back portion 9 of part 2. These guiding grooves are of an approximately arcuate configuration. With each of the two leaf springs 17 there is associated one guiding groove, and the two oppositely disposed guiding slots 19 have their apexes 19*a* side by side, while the ends 19*b* and 19*c* are farthest apart and equidistant, such that the guiding grooves are disposed in a mirror-image relationship.

When the two parts 1 and 2 are assembled, part 2 is introduced from the top, as seen in FIG. 1*c*, into the guiding groove 10 of part 1. As part 2 continues to be pressed in, its ramp 12 forces outwardly from part 1 the projections 18 at the ends of the leaf springs 17, so that they ride up onto the surface of the planar back portion 9 and, as part 2 continues to be pushed into part 1, they reach the point where they snap into the grooves 19 due to the spring action of the leaf springs 17. As part 2 is displaced with respect to part 1, the projections 18 in guiding grooves 19 are then spread apart or drawn together with respect to the lips 7 and 8 of part 1, and the leaf springs 17 are thus placed under tension. On account of the curvature of the two arms of the arcuate guiding groove 19, a reaction force is produced on either side of the apex 19*a*, which seeks to return part 2 and its hook 13 back to one of the two end positions, namely either to end position 19*b* or to end position 19*c*.

Part 1 is fastened to the wall by means of one or more screws inserted in holes 20 provided for the purpose, and after the part 2 has been inserted and fixed in place, the mirror can be inserted into the hook portion 13, and thus can be mounted on the wall in the conventional manner after an appropriate number of such hanging devices have been installed on the top and bottom edges of the mirror.

Figure 2B:
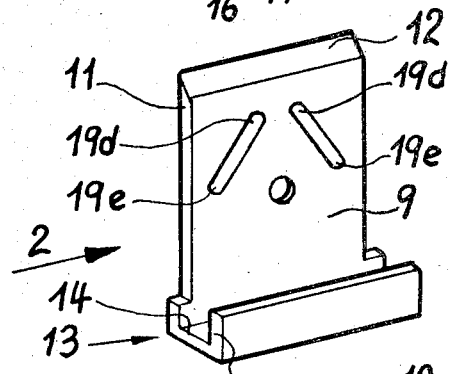
Figure 2C:
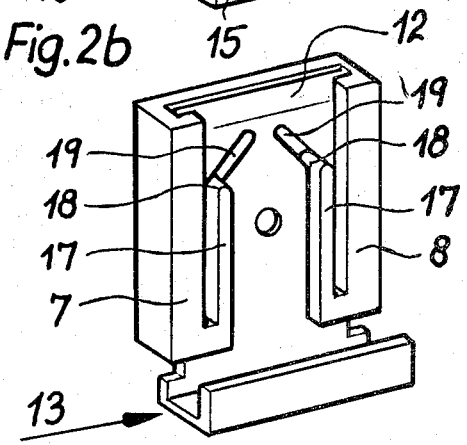
FIG. 2*c* shows the two parts of FIGS. 2*a* and 2*b* assembled.
Figure 3:
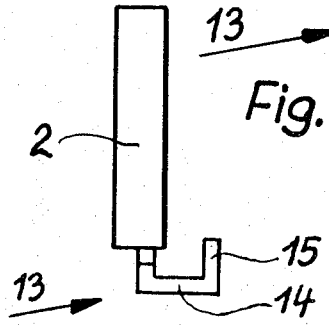
FIG. 3 is a side view of the hanger of the invention.

In an embodiment of the hanging devices corresponding to FIGS. 2*a* to 2*c*, part 1 is made in the same manner as described above. Part 2 is provided with straight, slanting guiding grooves which are very close to one another at their outer ends 19*d*, being separated, for example, only by a dividing portion along the longitudinal center line of part 2. The two guiding grooves 19 are separated farthest from one another at their ends 19*e* which are closely adjacent the longitudinal outside edges of part 2. The guiding grooves 19 this configured are much the same in their form and action as, say, one-half of the guiding grooves 19 in the embodiment corresponding to FIGS. 1*b* and 1*c*, as previously described, namely the portion directed upwardly from the apex 19*a* to the end 19*c*.

In the case of a hanging device in accordance with the embodiment represented in FIGS. 1*a* to 1*c*, the arcuate configuration of the guiding groove 19 results in two positions of rest, namely an outer position when the projections 18 are at the end 19*b* of the grooves, and an inner position when the projections 18 are at the ends 19*c* of the grooves 19. This hanger is suitable as a general-purpose hanger for mounting mirrors and pictures. The term, "general-purpose" means in this connection that the hanger can be used both at the bottom and at the top of a mirror or picture, the particular configuration of the guiding grooves allowing greater leeway in the location of the hangers. If the guiding grooves 19 are constructed accordingly, the hooks 14-15 of the hanger are capable of carrying the weight of the mirror or picture at either of its end positions. In other words, when the hanger is applied to the wall, if the bore provided is set too low on account of the particular circumstances, the hanger can be shifted such that the projections 19 will be in the raised-end position 19*b* in the guiding grooves 19. The upper hangers are applied such that part 2 is extended from part 1 to such a distance that the projections 18 are at the apex 19*a* of the guiding grooves 19, and when they are in this position the mirror, after insertion into the bottom hooks, can be swung in beneath the bottom edge of portion 15 of the hook-like portion. Then part 2 is pressed downwardly so that the projections snap into the portion of the guiding grooves 19 that lies between the apex 19*a* and the end point 19*c*. In this portion, the projections 18 apply themselves resiliently against the outsides of the guiding grooves 19 and thus seek to force themselves on into part 1, thereby ensuring a secure resilient grip of the hook on the top edge of the mirror or picture.

A hanger as shown in FIGS. 2*a* to 2*c* is best suited for mounting on the top edge of the mirror or picture when it is necessary for special reasons for the spring action to be substantially longer. It is mounted in the manner previously described in such a position that when the leaf springs 17 are relaxed, the hooked portion 14-15 is at the level of the top edge of the mirror or picture that has been inserted into the bottom hangers. The projections 18 are then in the guiding grooves 19, close to or in the position of their ends 19*e*. To install the picture or mirror, parts 2 are pushed upwardly, whereupon the projections 18 are forced inwardly on the converging guiding grooves 19, compressing the leaf springs 17 together, until the picture or mirror can be swung in beneath the lip 15 of the hook. When the hanger is released, the tension of the leaf springs 17 causes the projections 18 to spread apart and thereby cause part 2 to shift with respect to part 1, and the projections are guided in the slanting grooves 19 until the hook-like portion 14-15 engages the top edge of the mirror and the lip 15 of the hook in front of the mirror or picture secures the latter.

Figure 4:
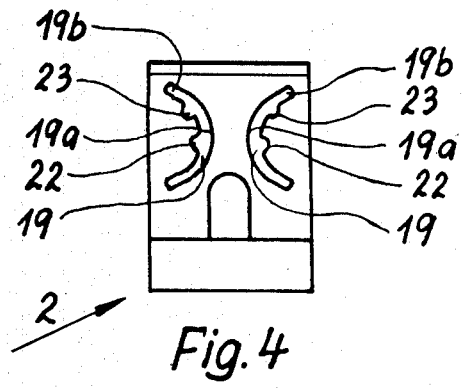
FIG. 4 is a front elevation of a further development of the design represented in FIG. 1*b;*

To facilitate the insertion of the mirror and effectively simplify the installation and setting of the hanger, detents are provided, in a further development of the invention, in the guiding grooves 19 as shown in FIG. 4, one detent 22 being disposed at the apex 19*a* and another 23 on the outer arm of the arcuate guiding groove 19, approximately in the middle between the apex 19*a* and the outer point 19*b*. The detent 22 ensures that, while the mirror or picture is being installed, the part 2 will be held in the otherwise inherently unstable position at the apex. The detent 23 serves especially to provide for leveling when the hanger is applied to the bottom edge of the mirror or picture.

Figure 6:
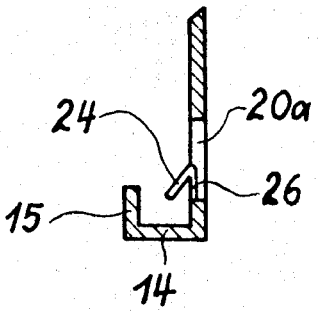
FIG. 6 is a side view of FIG. 5.
Figure 5:
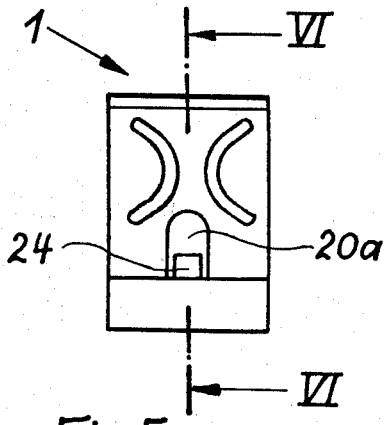
FIG. 5 is a front elevation of a further development of the hanger of the previous figures.
Figure 6A:
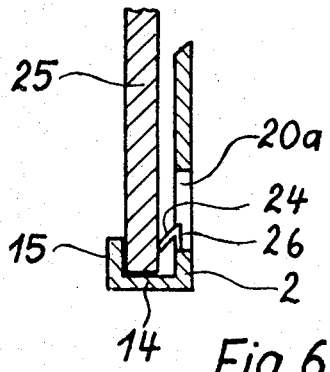
FIG. 6*a* is an enlarged cross section of a detail of FIG. 5, which is taken along line VI—VI thereof.

FIGS. 5 to 6*a* show how an elongated aperture 20*a* is disposed in part 2 so that the fastener in the form of a screw can be installed on part 1 by means of a screwdriver in the bore 20 underneath it, which can also be in the form of an elongated aperture. Advantageously, a resilient tongue 24 protruding at an angle from the planar portion of part 2 is formed at one end of the elongated aperture 20*a* therein, namely at the end adjacent the hook 14-15. It can be seen from the detail given in FIG. 6 that the mirror 25 placed behind the hook lip 15 is urged by this resilient tongue 24 from within against the lip 15, so that the back of it is held away from the hanger and any unevenness in the wall. The resilient tongue 24 serves to prevent the mirror 25 from wobbling or fluttering in the hangers and holds it at a good distance from the wall. This is important especially for installations in bathrooms, because the rear of the mirror will be well ventilated and safeguarded against oxidation of the reflective coating as well as other damage. To improve the spring action of the tongue 24, it can be provided with a shank 26 lying in the plane of part 2, this shank also having resilience.

I claim:

1. Hanging device comprising at least two parts guided for displacement one on the other and made of spring-elastic plastic, having a first part (1) which includes at least one leaf spring (17) which is provided at its free end with a projection (18) for engagement in a guiding groove (19) which is disposed in a second part (2) at an angle to the leaf spring, the guiding groove (19) being curved and forming an arc of a circle, said arc having an apex and two end portions; said second part (2) further comprises a base plate (9) in which the guiding grooves (19) and an elongated hole (20*a*) are disposed and which is provided with a fastening means (14, 15) having a hooked portion with a lip (15), said hooked portion lying outside of the first part (1), and a resilient tongue (24) protruding at an angle from the plane of the second part (2) is disposed opposite the lip (15) of the hook portion; said resilient tongue (24) is formed on a shank (26) lying in the plane of the second part (2) and extending into said elongated hole (20*a*).

2. Hanging device of claim 1 characterized in that two leaf springs (17) are provided, with each of the leaf springs a guiding groove (19) is associated, the guiding grooves (19) being arranged in a substantially mirror-image relationship.

3. Hanging device of claim 1 characterized in that two arcuate guiding grooves are provided with their apexes adjacent one another.

4. Hanging device of claim 1, 2 or 3 characterized in that the guiding grooves (19) are provided with at least one detent (22, 23) for engaging the projection (18) on the leaf spring (17), said detent (22, 23) being formed in the direction of the spring action.

5. Hanging device of claim 4 characterized in that a plurality of detents (22, 23) is provided, at least one detent (22) is disposed at the apex (19*a*) of the guiding groove (19) and an additional detent (23) is disposed at a position between the apex (19*a*) and the end portion (19*b*) of said guiding groove (19).

6. Hanging device of claim 1 characterized in that the length of movement of first part (1) along the guiding grooves (19) from the apex (19*a*) to one of the ends (19*b*) or (19*c*) is a movement at least as long as the height of the lip (15) of the hooked portion.

7. Hanging device of claim 1 characterized in that in the base plate (9) of the second part an elongated hole (20*a*) is disposed as a passage for a screwdriver to a through-bore (20) in the first part (1) for the accomodation of a fastening means.

8. Hanging device of claim 1 characterized in that the shank (26) is of resilient construction.

* * * * *